US008515308B2

(12) United States Patent
Awano

(10) Patent No.: US 8,515,308 B2
(45) Date of Patent: Aug. 20, 2013

(54) GEAR CENTER-DISTANCE MAINTAINING MECHANISM, IMAGE FORMING APPARATUS, AND ASSEMBLY

(75) Inventor: Toyohiko Awano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 335 days.

(21) Appl. No.: 12/939,749

(22) Filed: Nov. 4, 2010

(65) Prior Publication Data

US 2011/0262182 A1 Oct. 27, 2011

(30) Foreign Application Priority Data

Apr. 23, 2010 (JP) ..... 2010-099878

(51) Int. Cl.
*G03G 21/16* (2006.01)

(52) U.S. Cl.
USPC ..... 399/111; 399/107; 74/395; 74/396; 74/397; 74/405; 74/409; 74/411

(58) Field of Classification Search
USPC ..... 399/107, 111; 74/395–397, 405, 74/409, 411
See application file for complete search history.

(56) References Cited

U.S. PATENT DOCUMENTS 7,225,697 B2 * 6/2007 Schalk et al. ..... 74/405
2010/0150613 A1 6/2010 Furuta et al.

FOREIGN PATENT DOCUMENTS

EP 1 273 980 A2 1/2003
JP 10-104908 A 4/1998

* cited by examiner

*Primary Examiner* — Ryan Walsh
(74) *Attorney, Agent, or Firm* — Sughrue Mion, PLLC

(57) ABSTRACT

A gear center-distance maintaining mechanism includes a first support body that rotatably supports a first gear to be rotated by driving force from a driving unit, a second support body that rotatably supports a second gear to be meshed with the first gear so as to transmit rotational force from the first gear to a rotating body, the second support body being movable relative to the first support body in a direction such that the second gear moves away from the first gear, an arc-shaped face provided in the second support body and centered on an axis of the second gear, and a restricting portion provided in the first support body and shaped like an arc centered on an axis of the first gear, the restricting portion restricting the movement of the second support body relative to the first support body by contact with the arc-shaped face.

3 Claims, 4 Drawing Sheets

GEAR CENTER-DISTANCE MAINTAINING MECHANISM, IMAGE FORMING APPARATUS, AND ASSEMBLY

CROSS-REFERENCE TO RELATED APPLICATIONS

This application is based on and claims priority under 35 USC 119 from Japanese Patent Application No. 2010-099878 filed Apr. 23, 2010.

BACKGROUND

Technical Field

The present invention relates to a gear center-distance maintaining mechanism, an image forming apparatus, and an assembly.

SUMMARY

According to an aspect of the invention, there is provided a gear center-distance maintaining mechanism including a first support body that rotatably supports a first gear to be rotated by driving force from a driving unit; a second support body that rotatably supports a second gear to be meshed with the first gear so as to transmit rotational force from the first gear to a rotating body, the second support body being movable relative to the first support body in a direction such that the second gear moves away from the first gear; an arc-shaped face provided in the second support body and centered on an axis of the second gear; and a restricting portion provided in the first support body and shaped like an arc centered on an axis of the first gear, the restricting portion restricting the movement of the second support body relative to the first support body by contact with the arc-shaped face.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Configuration of Image Forming Apparatus According to Exemplary Embodiment

Figure 1:
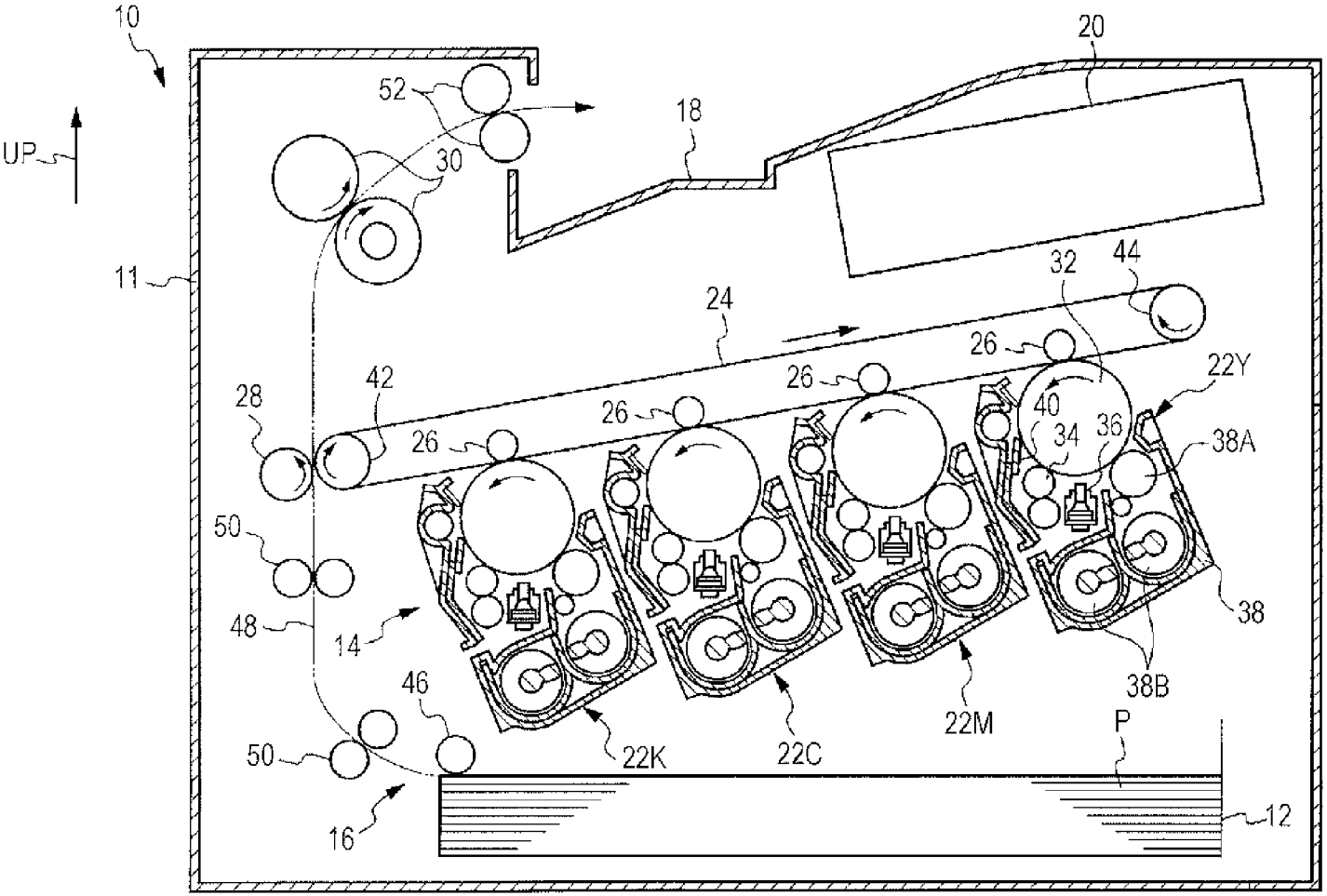
FIG. 1 schematically illustrates a configuration of an image forming apparatus according to an exemplary embodiment.

First, a configuration of an image forming apparatus 10 according to the exemplary embodiment will be described. FIG. 1 schematically illustrates the configuration of the image forming apparatus of the exemplary embodiment. In FIG. 1, an arrow UP indicates the vertical upward direction.

As illustrated in FIG. 1, the image forming apparatus 10 has an image-forming-apparatus body 11 in which components are stored.

The image-forming-apparatus body 11 includes a recording-medium storage unit 12 that stores recording media P such as paper, an image forming unit 14 that forms images on the recording media P, a transport unit 16 that transports the recording media P from the recording-medium storage unit 12 to the image forming unit 14, and a controller 20 that controls operations of the components of the image forming apparatus 10. Also, a recording-medium output unit 18 into which the recording media P are output after image formation by the image forming unit 14 is provided at the top of the image-forming-apparatus body 11.

The image forming unit 14 includes image forming units 22Y, 22M, 22C, and 22K (hereinafter referred to as the image forming units 22Y to 22K), an intermediate transfer belt 24, first transfer rollers 26 (examples of conductive rollers), and a second transfer roller 28. The image forming units 22Y to 22K form toner images of yellow (Y), magenta (M), cyan (C), and black (K) colors, respectively. The intermediate transfer belt 24 serves as an example of a transfer body on which the toner images formed by the image forming units 22Y to 22K are transferred. The first transfer rollers 26 serve as examples of first transfer members that transfer the toner images formed by the image forming units 22Y to 22K onto the intermediate transfer belt 24. The second transfer roller 28 serves as an example of a second transfer member that transfers the toner images, which are transferred on the intermediate transfer belt 24 by the first transfer rollers 26, from the intermediate transfer belt 24 onto a recording medium P.

The image forming units 22Y to 22K are arranged side by side in the center portion of the image forming apparatus 10 in the up-down direction, and are inclined with respect to the horizontal direction. Further, the image forming units 22Y to 22K have respective photoconductors 32 that rotate in one direction (counterclockwise in FIG. 1) as image carriers for carrying images. Since the image forming units 22Y to 22K have similar structures, the signs of the components of the image forming units 22M, 22C, and 22K are not shown in FIG. 1.

Around each photoconductor 32, a charging roller 34, an exposure device 36, a developing device 38, and a removing device 40 are arranged in order from the upstream side in the rotating direction of the photoconductor 32. The charging roller 34 serves as an example of a charging device that charges the photoconductor 32. The exposure device 36 exposes the photoconductor 32 charged by the charging roller 34 so as to form an electrostatic latent image. The developing device 38 develops the electrostatic latent image formed on the photoconductor 32 by the exposure device 36 so as to form a toner image. The removing device 40 removes toner remaining on the photoconductor 32 after the toner image formed on the photoconductor 32 is transferred onto the intermediate transfer belt 24.

The exposure device 36 forms an electrostatic latent image on the basis of image signals transmitted from the controller 20. For example, image signals transmitted from the controller 20 are image signals that the controller 20 acquires from an external apparatus.

The developing device 38 includes a developing body 38A that develops a latent image by supplying developer to the photoconductor 32, and plural transport members 38B that agitate and transport the developer to the developing body 38A.

As illustrated in FIG. 1, the intermediate transfer belt 24 is annular, and is provided above the image forming units 22Y to 22K. On an inner peripheral side of the intermediate transfer belt 24, winding rollers 42 and 44 are provided such that the intermediate transfer belt 24 is wound therearound. When any of the winding rollers 42 and 44 rotates, the intermediate transfer belt 24 rotates in one direction (clockwise in FIG. 1) while being in contact with the photoconductors 32.

Figure 2:
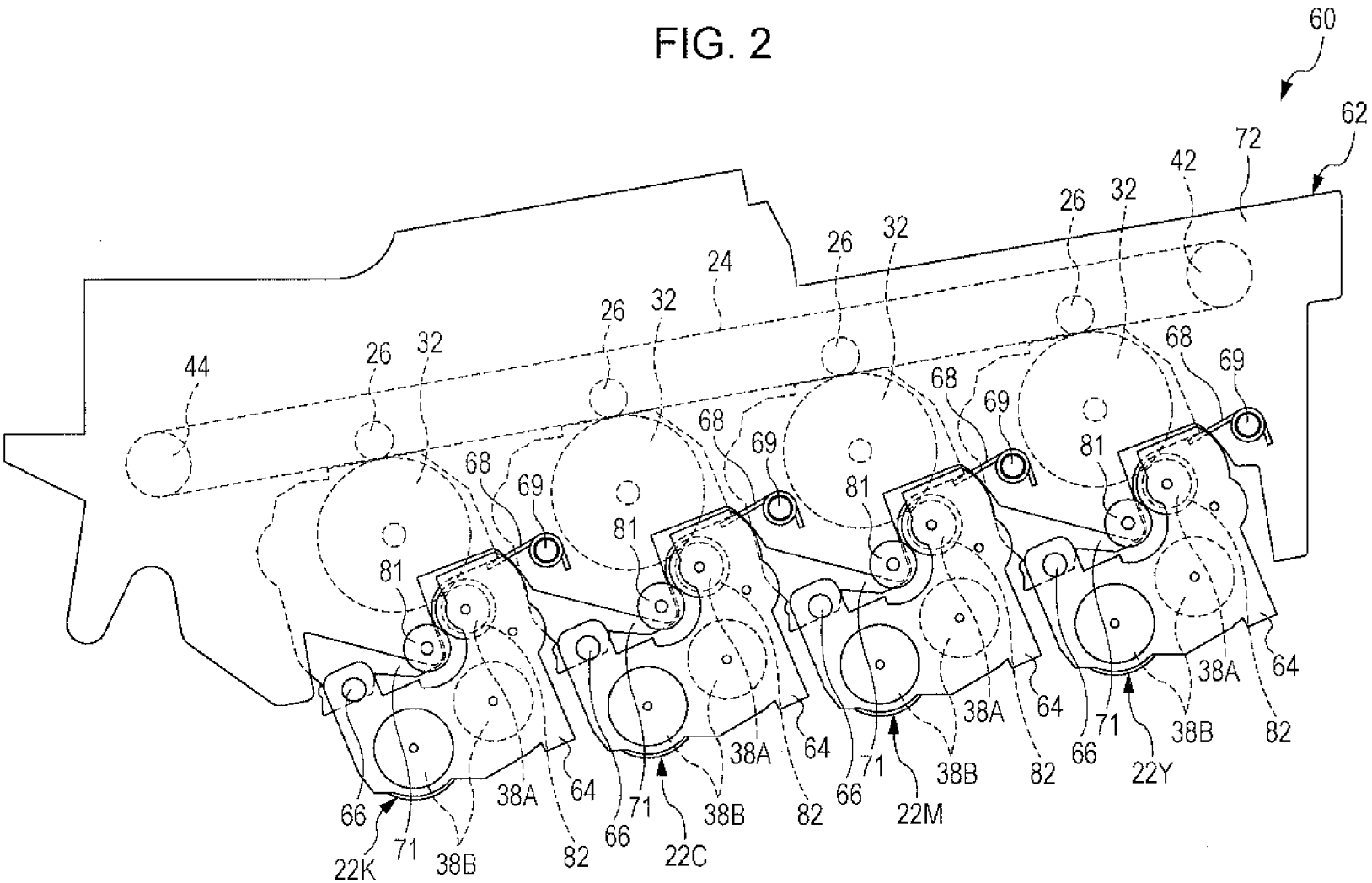
FIG. 2 schematically illustrates a structure of an intermediate transfer unit in the exemplary embodiment.

The winding roller 42 serves as an opposing roller that opposes the second transfer roller 28. As illustrated in FIG. 2, the intermediate transfer belt 24 and the image forming units 22Y to 22K constitute an intermediate transfer unit 60. A detailed structure of the intermediate transfer unit 60 will be described below.

As illustrated in FIG. 1, each first transfer roller 26 opposes the corresponding photoconductor 32 with the intermediate transfer belt 24 being disposed therebetween. A position between the first transfer roller 26 and the photoconductor 32 serves as a first transfer position where a toner image formed on the photoconductor 32 is transferred onto the intermediate transfer belt 24. The first transfer roller 26 is in contact with the intermediate transfer belt 24, and rotates while following the rotation of the intermediate transfer belt 24.

The second transfer roller 28 opposes the winding roller 42 with the intermediate transfer belt 24 being disposed therebetween. A position between the second transfer roller 28 and the winding roller 42 serves as a second transfer position where the toner image transferred on the intermediate transfer belt 24 is transferred onto a recording medium P.

The transport unit 16 includes a feeding roller 46 that feeds out a recording medium P from the recording-medium storage unit 12, a transport path 48 through which the recording medium P fed out by the feeding roller 46 is transported, and plural transport rollers 50 arranged along the transport path 48. The transport rollers 50 transport the recording medium P fed out by the feeding roller 46 to the second transfer position.

On the downstream side of the second transfer position in the transport direction, a fixing device 30 is provided to fix the toner image, which is transferred from the intermediate transfer belt 24 onto the recording medium P at the second transfer position by the second transfer roller 28, on the recording medium P. Further on the downstream side of the fixing device 30 in the transport direction, output rollers 52 are provided to output, to the recording-medium output unit 18, the recording medium P on which the toner image is fixed.

Next, a description will be given of an image forming operation performed to form an image on a recording medium P in the image forming apparatus 10 of the exemplary embodiment.

In the image forming apparatus 10 of the exemplary embodiment, a recording medium P is fed out from the recording-medium storage unit 12 by the feeding roller 46, and is transported to the second transfer position by the plural transport rollers 50.

In contrast, in the image forming units 22Y to 22K, the photoconductors 32 charged by the charging rollers 34 are exposed by the exposure devices 36, whereby electrostatic latent images are formed on the photoconductors 32. Then, the electrostatic latent images are developed by the developing devices 38 to form color toner images on the photoconductors 32. The color toner images formed by the image forming units 22Y to 22K are superimposed on the intermediate transfer belt 24, so that a multicolor image is formed. The multicolor image formed on the intermediate transfer belt 24 is then transferred onto the recording medium P at the second transfer position.

The recording medium P, on which the toner image is transferred, is transported to the fixing device 30, where the transferred toner image is fixed. After fixing, the recording medium P is output to the recording-medium output unit 18 by the output rollers 52. A series of image forming steps are performed, as described above.

Structure of Intermediate Transfer Unit 60

Next, the structure of the intermediate transfer unit 60 will be described. FIG. 2 schematically illustrates the structure of the intermediate transfer unit 60.

As illustrated in FIG. 2, the intermediate transfer unit 60 includes the image forming units 22Y to 22K, the intermediate transfer belt 24, the winding rollers 42 and 44, the four first transfer rollers 26, a first support body 62 that rotatably supports the winding rollers 42 and 44, the four photoconductors 32, and the four first transfer rollers 26, and second support bodies 64 that rotatably support the developing bodies 38A and the transport members 38B.

The intermediate transfer unit 60 is removably mounted in the image-forming-apparatus body 11 (see FIG. 1), and forms an example of an assembly that is integrally removed from the image-forming-apparatus body 11.

The first support body 62 is fixed to the image-forming-apparatus body 11 (hereinafter the first support body 62 will be referred to as a fixed support body 62). The second support bodies 64 are movably attached to the fixed support body 62 (hereinafter the second support bodies 64 will be referred to as movable support bodies 64).

The fixed support body 62 includes four first support members 71 that rotatably respectively support the four photoconductors 32, and a second support member 72 that supports the four first support members 71 and that rotatably supports the winding rollers 42 and 44 and the first transfer rollers 26.

Figure 3:
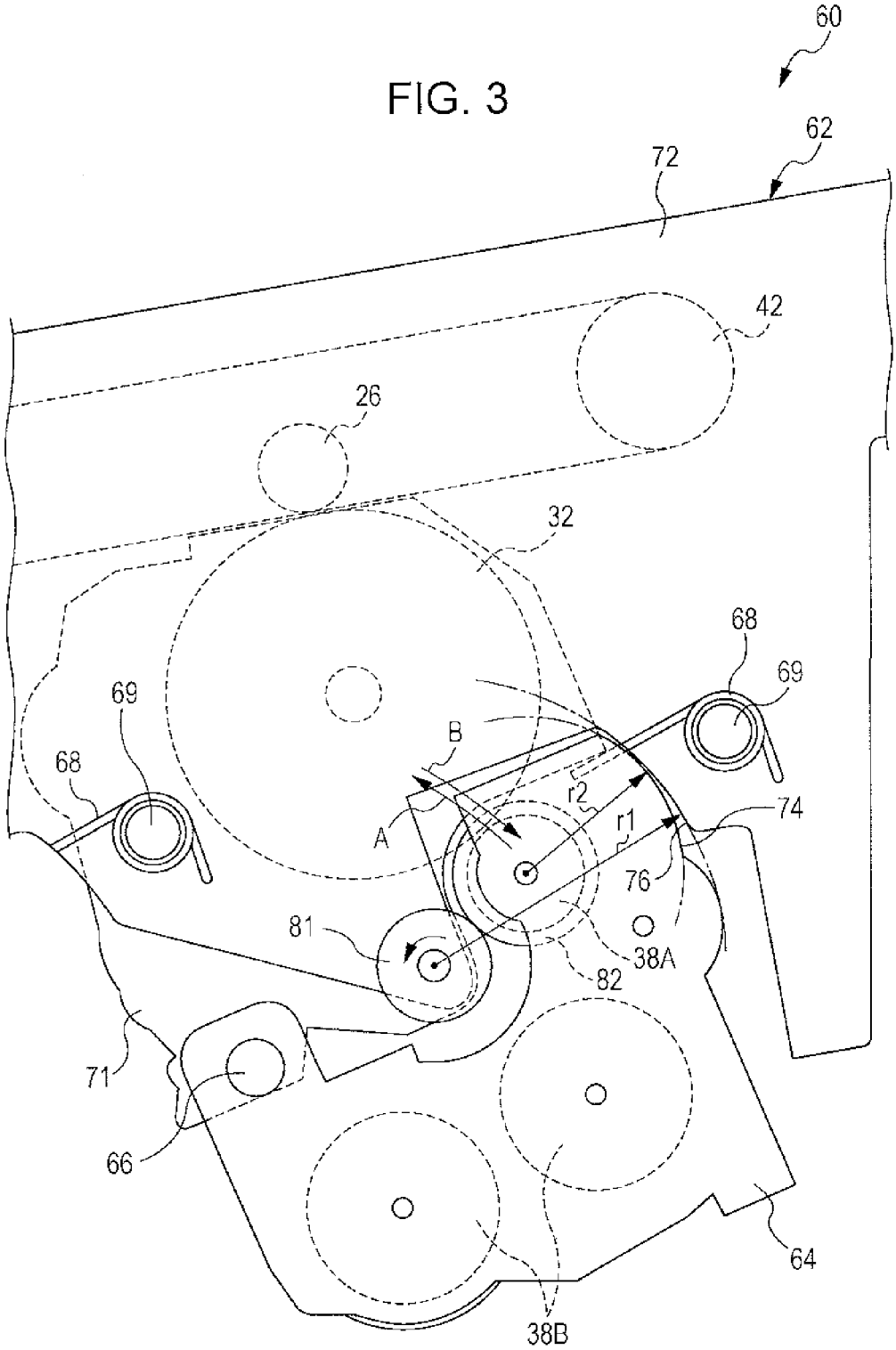
FIG. 3 is a partially enlarged schematic view of the structure illustrated in FIG. 2.

As illustrated in FIG. 3, a first gear 81 is rotatably supported by the second support member 72 of the fixed support body 62. The first gear 81 transmits driving force from a driving unit (not shown) to a second gear 82, which will be described below, in contact with the second gear 82. The first gear 81 may be rotatably supported by the corresponding first support member 71.

The second support member 72 is fixed to the image-forming-apparatus body 11, and the first support members 71 are fixed to the second support member 72. Thus, the positions of the first support members 71 and the second support member 72 relative to the image-forming-apparatus body 11 are fixed.

Figure 4:
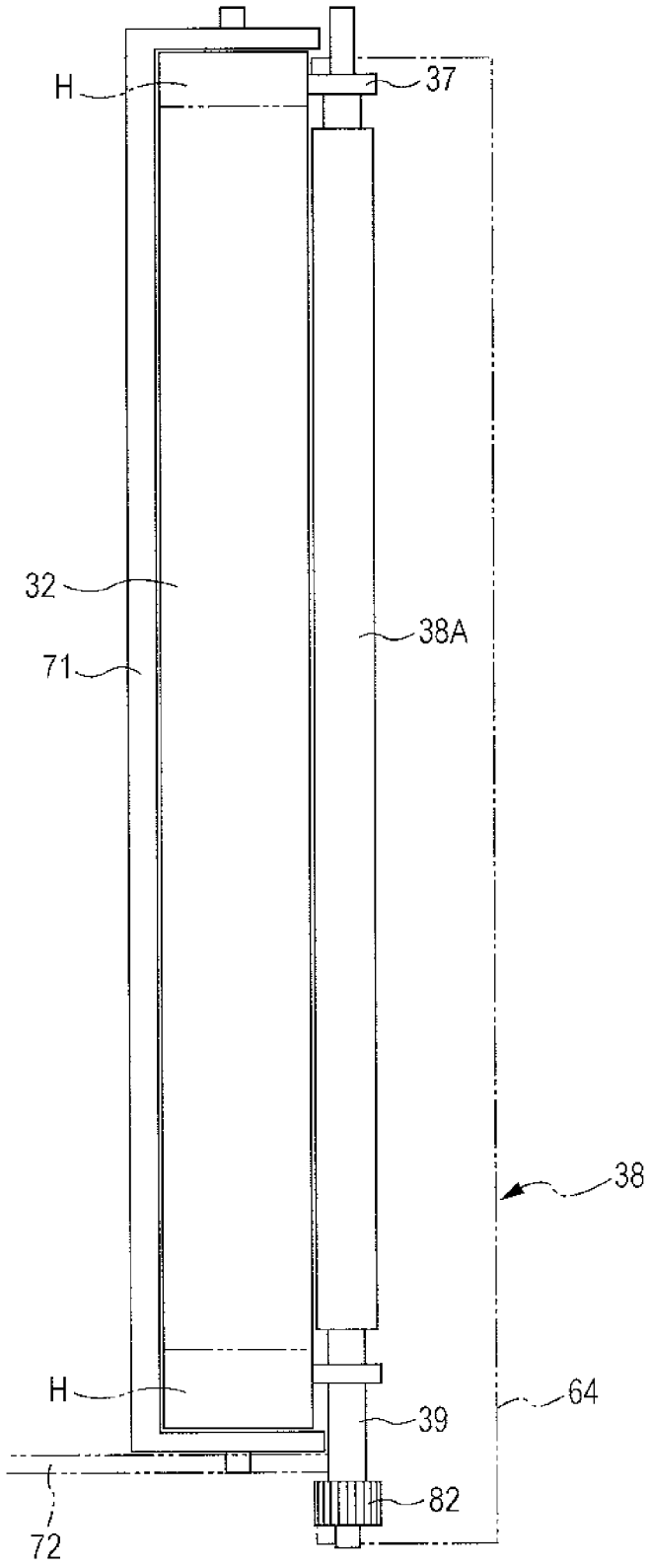
FIG. 4 is a schematic view illustrating structures of a photoconductor and a developing body in the exemplary embodiment.

Although not shown in FIGS. 3 and 4, each of the first support members 71 supports the charging roller 34, the exposure device 36, and the removing device 40 as well as the photoconductor 32.

Each of the movable support bodies 64 rotatably supports the developing body 38A and the transport members 38B. Each of the developing devices 38 includes the movable support body 64, the developing body 38A, and the transport members 38B.

A second gear 82 is rotatably supported by the movable support body 64 at one axial end of the developing body 38A and coaxially with the developing body 38A. The second gear 82 transmits driving force from the first gear 81 to the developing body 38A by mesh with the first gear 81.

The movable support body 64 is turnably supported relative to the first support member 71 of the fixed support body 62 on a shaft portion 66 that is not coaxial with the photoconductor 32, the first gear 81, and the second gear 82. This allows the movable support body 64 to turn on the axis of the shaft portion 66 in a direction such that the developing body 38A moves closer to and away from the photoconductor 32 (in the directions of arrows A and B in FIG. 3).

By turning on the axis of the shaft portion 66, the movable support body 64 is movable in a direction such that the center distance between the first gear 81 and the second gear 82 changes (direction of arrow B in FIG. 3), more specifically, a direction such that the second gear 82 moves away from the first gear 81.

The first gear 81 rotates in a rotating direction (counterclockwise in FIG. 3) such that thrust force in the direction, in which the developing body 38A moves closer to the photoconductor 32 (direction of arrow A in FIG. 3) is applied to the second gear 82.

Also, a torsion spring 68 is provided on the support portion 72. The torsion spring 68 is an example of an application member that applies, to the movable support body 64, thrust force in a direction in which the developing body 38A moves closer to the photoconductor 32 (direction of arrow A in FIG. 3). More specifically, the torsion spring 68 presses the movable support body 64 in the direction of arrow A in FIG. 3 by the elastic force thereof.

With this, the developing body 38A is pressed toward the photoconductor 32 (direction of arrow A in FIG. 3), and flange portions 37 provided at either axial end of the developing body 38A make contact with non-image areas H at either axial end of the photoconductor 32, whereby the center distance between the developing body 38A and the photoconductor 32 is defined, as illustrated in FIG. 4. The flange portions 37 have a diameter larger than the diameter of the developing body 38A.

As illustrated in FIG. 3, in the exemplary embodiment, the movable support body 64 has an arc-shaped face 74 centered on the axis of the second gear 82. Further, the support member 72 of the fixed support body 62 has an arc-shaped restricting portion 76 centered on the axis of the first gear 81. The restricting portion 76 restricts the movement of the movable support body 64 relative to the fixed support body 62 by contact with the arc-shaped face 74.

The arc-shaped face 74 and the restricting portion 76 are located on a side (on the right upper side in FIG. 3, hereinafter simply referred to as the right upper side) of the second gear 82 opposite a side where the first gear 81 and the shaft portion 66 are provided (on the left lower side in FIG. 3, hereinafter simply referred to as the left lower side). The arc-shaped face 74 is curved to be convex on the right upper side, that is, formed by a curved face pointing toward the right upper side.

In contrast, the restricting portion 76 is curved to be concave on the right upper side, that is, formed by a curved face opposing the arc-shaped face 74. Because of the above-described arrangement, a radius r1 of the restricting portion 76 is set to be larger than a radius r2 of the arc-shaped face 74.

Operation of Exemplary Embodiment

Next, the operation of the exemplary embodiment will be described.

In the intermediate transfer unit 60 of the image forming apparatus 10, each movable support body 64 is pressed in the direction of arrow A in FIG. 3 by the action of the torsion spring 68 and so on. With this, the flange portions 37 at either axial end of the developing body 38A make contact with the non-image areas H on either axial end of the photoconductor 32, so that the center distance between the developing body 38A and the photoconductor 32 is defined.

When the force in the direction of arrow B in FIG. 3 acts on the movable support body 64 against the torsion spring 68 and so on, the movable support body 64 turns in that direction on the axis of the shaft portion 66. The movable support body 64 does not turn on the axis of the first gear 81, but turns on the axis of the shaft portion 66 serving as the support center in the direction such that the second gear 82 moves away from the first gear 81.

In the exemplary embodiment, the restricting portion 76 restricts the movement of the movable support body 64 relative to the fixed support body 62 by contact with the arc-shaped face 74.

The distance of the restricting portion 76 from the axis of the first gear 81 is fixed, and the distance of the arc-shaped face 74 from the second gear 82 is fixed. Therefore, even if the contact position between the restricting portion 76 and the arc-shaped face 74 changes, the movable support body 64 turns along the restricting portion 76 in the circumferential direction centered on the axial of the first gear 81. This restricts the change in center distance between the first gear 81 and the second gear 82.

The arcs of the arc-shaped face 74 and the restricting portion 76 do not always need to be shaped like an arc of a true circle, and may be in an arc shape within the range such that the change in center distance between the first gear 81 and the second gear 82 is suppressed so that at least tooth jumping therebetween is prevented. Therefore, it is satisfactory as long as the distance between the restricting portion 76 and the axis of the first gear 81 and the distance between the arc-shaped face 74 and the axis of the second gear 82 are fixed within that range.

While the movable support body 64 turns relative to the fixed support body 62 in the exemplary embodiment, alternatively, the movable support body 64 may move relative to the fixed support body 62 in a linear direction or other directions.

While the fixed support member 62 is formed by the first support members 71 and the second support member 72 in the exemplary embodiment, it may be formed by one, three, or more components.

While the second gear 82 is located coaxially with the developing body 38A in the exemplary embodiment, it may not be coaxially with the developing body 38A.

While the intermediate transfer unit 60 including the intermediate transfer belt 24 is an example of an assembly in the exemplary embodiment, the assembly may not include the intermediate transfer belt 24.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent-image carrier that carries a latent image;

a first support body that supports the latent-image carrier;

a first gear that is rotatably supported by the first support body and is rotated by driving force from a driving unit;

a developing body that develops the latent image on the latent-image carrier;

a second gear that transmits rotational force from the first gear to the developing body by mesh with the first gear;

a second support body that rotatably supports the developing body and the second gear, the second support body being movable relative to the first support body in a direction such that the second gear moves away from the first gear;

an arc-shaped face provided in the second support body and centered on an axis of the second gear; and an arc shaped restricting portion provided in the first support body, centered on an axis of the first gear, the arc shaped restricting portion restricting the movement of the second support body relative to the first support body by contact with the arc-shaped face.

2. The image forming apparatus according to claim 1, wherein the first support body supports a plurality of the latent-image carriers and a transfer body on which images developed by the developing body are transferred from the plurality of latent-image carriers.

3. An assembly integrally removably mounted in an apparatus body, comprising:

a latent-image carrier that carries a latent image;

a first support body that supports the latent-image carrier;

a first gear that is rotatably supported by the first support body and is rotated by driving force from a driving unit;

a developing body that develops the latent image;

a second gear that transmits rotational force from the first gear to the developing body by mesh with the first gear;

a second support body that rotatably supports the developing body and the second gear, the second support body being movable relative to the first support body in a direction such that the second gear moves away from the first gear;

an arc-shaped face provided in the second support body and centered on an axis of the second gear; and an arc shaped restricting portion provided in the first support body, centered on an axis of the first gear, the arc shaped restricting portion restricting the movement of the second support body relative to the first support body by contact with the arc-shaped face.

* * * * *